US008936182B2

(12) United States Patent
Grasso et al.

(10) Patent No.: US 8,936,182 B2
(45) Date of Patent: Jan. 20, 2015

(54) ADAPTABLE RACK FOR AQUATIC TRANSPORT OF ARTICLES

(75) Inventors: Michael Grasso, Freehold, NJ (US); Jonathan Fallon, Freehold, NJ (US)

(73) Assignee: Michael Grasso, Freehold, NJ (US)

( * ) Notice: Subject to any disclaimer, the term of this patent is extended or adjusted under 35 U.S.C. 154(b) by 282 days.

(21) Appl. No.: 13/159,315

(22) Filed: Jun. 13, 2011

(65) Prior Publication Data

US 2011/0303713 A1 Dec. 15, 2011

Related U.S. Application Data

(60) Provisional application No. 61/353,692, filed on Jun. 11, 2010, provisional application No. 61/386,443, filed on Sep. 24, 2010.

(51) Int. Cl.

| | |
|---|---|
| ***B60R 9/00*** | (2006.01) |
| ***B60R 11/00*** | (2006.01) |
| ***B63B 25/28*** | (2006.01) |

(52) U.S. Cl.

CPC ..... *B63B 25/28* (2013.01)
USPC ..... 224/406; 224/525; 224/529; 224/531; 224/532

(58) Field of Classification Search

USPC ..... 224/406, 519, 532, 533, 525, 528, 529, 224/531; 114/343
See application file for complete search history.

(56) References Cited

U.S. PATENT DOCUMENTS

| | | | | | |
|---|---|---|---|---|---|
| 2,782,052 | A | * | 2/1957 | Albrecht et al. | 280/769 |
| 3,291,427 | A | * | 12/1966 | Hutchings | 248/201 |
| 3,527,354 | A | * | 9/1970 | Sokolow | 211/70.5 |
| 3,587,123 | A | * | 6/1971 | O'Boyle | 114/362 |
| 3,805,722 | A | * | 4/1974 | Melchert et al. | 114/343 |
| 3,811,143 | A | * | 5/1974 | Page | 114/343 |
| 3,925,836 | A | * | 12/1975 | Simmonds | 114/364 |
| 4,027,880 | A | * | 6/1977 | Hadtke | 473/426 |
| 4,232,806 | A | * | 11/1980 | Shald | 224/406 |
| 4,234,112 | A | * | 11/1980 | Gallant | 224/559 |
| 4,372,243 | A | * | 2/1983 | Roope, Jr. | 114/364 |
| 4,582,015 | A | * | 4/1986 | Hunter | 114/343 |
| 4,712,503 | A | * | 12/1987 | Ritten | 114/343 |
| 4,858,802 | A | * | 8/1989 | Hamby et al. | 224/406 |
| 4,942,989 | A | * | 7/1990 | Miller | 224/546 |
| 5,105,754 | A | * | 4/1992 | Collins | 114/343 |
| D341,121 | S | * | 11/1993 | Trahan, Sr. | D12/318 |
| 5,454,342 | A | * | 10/1995 | Colquett et al. | 114/364 |
| 5,636,587 | A | * | 6/1997 | Klimowicz | 114/259 |
| 5,752,638 | A | * | 5/1998 | Meeks | 224/547 |
| 5,901,890 | A | * | 5/1999 | Stokes | 224/406 |
| 6,101,966 | A | * | 8/2000 | Cumisky | 114/364 |
| 6,786,373 | B2 | * | 9/2004 | Pierce et al. | 224/501 |

(Continued)

*Primary Examiner* — Justin Larson
*Assistant Examiner* — Lester L Vanterpool
(74) *Attorney, Agent, or Firm* — Jon Fallon, Esq.; Michael P. Kochka, Esq.

(57) ABSTRACT

Embodiments of the present invention generally relate to an adaptable rack for aquatic transport of articles. More specifically, embodiments of the present invention relate to an adaptable rack for aquatic transport of articles to increase storage capacity of a boat and to prevent scuffing and damaging of the deck of the boat. In one embodiment of the present invention, an adaptable rack for aquatic transport of an article comprises a mounting post for fitting inside a rocket launcher on a boat, a support bar positioned on a top surface of the mounting post, and a plurality of support arms extending from the support bar, the support arms for supporting the article during aquatic transport.

13 Claims, 6 Drawing Sheets

(56) References Cited

U.S. PATENT DOCUMENTS

| | | | | |
|---|---|---|---|---|
| 6,866,001 | B1 * | 3/2005 | Cuccia | 114/343 |
| 6,921,007 | B1 * | 7/2005 | Guerrant | 224/519 |
| 7,775,176 | B2 * | 8/2010 | Abel | 114/364 |
| 2004/0089218 | A1 * | 5/2004 | Cannon, Jr. | 114/343 |
| 2005/0133556 | A1 * | 6/2005 | Bolin | 224/509 |
| 2006/0011683 | A1 * | 1/2006 | Held | 224/406 |
| 2007/0062992 | A1 * | 3/2007 | Hepworth et al. | 224/406 |

* cited by examiner

ADAPTABLE RACK FOR AQUATIC TRANSPORT OF ARTICLES

CROSS-REFERENCE TO RELATED APPLICATIONS

This application claims priority to U.S. Provisional Patent Application Ser. No. 61/353,692, filed Jun. 11, 2010, entitled "Adaptable Rack for Aquatic Transport of Bicycles and Other Devices," the disclosure of which is incorporated herein by reference in its entirety. This application also claims priority to U.S. Provisional Patent Application Ser. No. 61/386,443, filed Sep. 24, 2010, entitled "Adaptable Rack for Aquatic Transport of Bicycles and Other Devices," the disclosure of which is incorporated herein by reference in its entirety.

BACKGROUND OF THE INVENTION

1. Field of the Invention

Embodiments of the present invention generally relate to an adaptable rack for aquatic transport of articles. More specifically, embodiments of the present invention relate to an adaptable rack for aquatic transport of articles to increase storage capacity of a boat and to prevent scuffing and damaging of the deck of the boat.

2. Description of Related Art

Many people who live on or near a body of water (i.e., ocean, sea, river, lake, etc.) own boats for either recreational purposes, commercial purposes or both. For many people who own boats on lakes or intercoastal waterways, or for those who do not tend to travel at sea for days at a time, travelling across the body of water to another land-based location is quite common. For example, a boat owner may travel across a lake to a beach area and dock for the day. Despite the ability for the boat owner to travel there by foot or by car (by going around the lake), it is not uncommon for boat owners to travel in such a fashion.

Regardless of the size of the boat or the intended destination, most boat owners agree there is never enough for storage of articles, devices, safety equipment, or the like. For example, in the situation described above, the boat owner may need to travel with any number of articles for the intended destination. Whether it be a cooler, a bicycle, a suitcase, scuba gear, or the like, the limited space on the deck of a boat does not provide for sufficient storage room to travel comfortably. In addition, when actually placed on the deck of a boat, many of such articles can cause damage to the surface of the deck, requiring the boat owner to spend time and money maintaining the deck of the boat.

Thus, there is a need for an adaptable rack for the aquatic transport of articles to increase storage capacity of a boat and to prevent scuffing and damaging of the deck of the boat.

SUMMARY

Embodiments of the present invention generally relate to an adaptable rack for aquatic transport of articles. More specifically, embodiments of the present invention relate to an adaptable rack for aquatic transport of articles to increase storage capacity of a boat and to prevent scuffing and damaging of the deck of the boat.

In one embodiment of the present invention, an adaptable rack for aquatic transport of an article comprises a mounting post for fitting inside a rocket launcher on a boat, a support bar positioned on a top surface of the mounting post, and a plurality of support arms extending from the support bar, the support arms for supporting the article during aquatic transport.

In another embodiment of the present invention, an adaptable rack for aquatic transport of an article comprises a mounting post, a support bar positioned on a top surface of the mounting post, a plurality of support arms extending from the support bar, the support arms for supporting the article during aquatic transport, and at least one railing bracket for connecting to a railing on a boat.

In yet another embodiment of the present invention, an adaptable rack comprises a mounting post for fitting inside a rocket launcher on a boat, a support bar positioned on a top surface of the mounting post, and a plurality of support arms extending from the support bar, the support arms affixed to one of a storage apparatus or an article.

BRIEF DESCRIPTION OF THE DRAWINGS

So the manner in which the above recited features of the present invention can be understood in detail, a more particular description of embodiments of the present invention, briefly summarized above, may be had by reference to embodiments, one of which is illustrated in the appended drawings. It is to be noted, however, the appended drawings illustrate only typical embodiments of embodiments encompassed within the scope of the present invention, and, therefore, is not to be considered limiting, for the present invention may admit to other equally effective embodiments.

Figure 1:
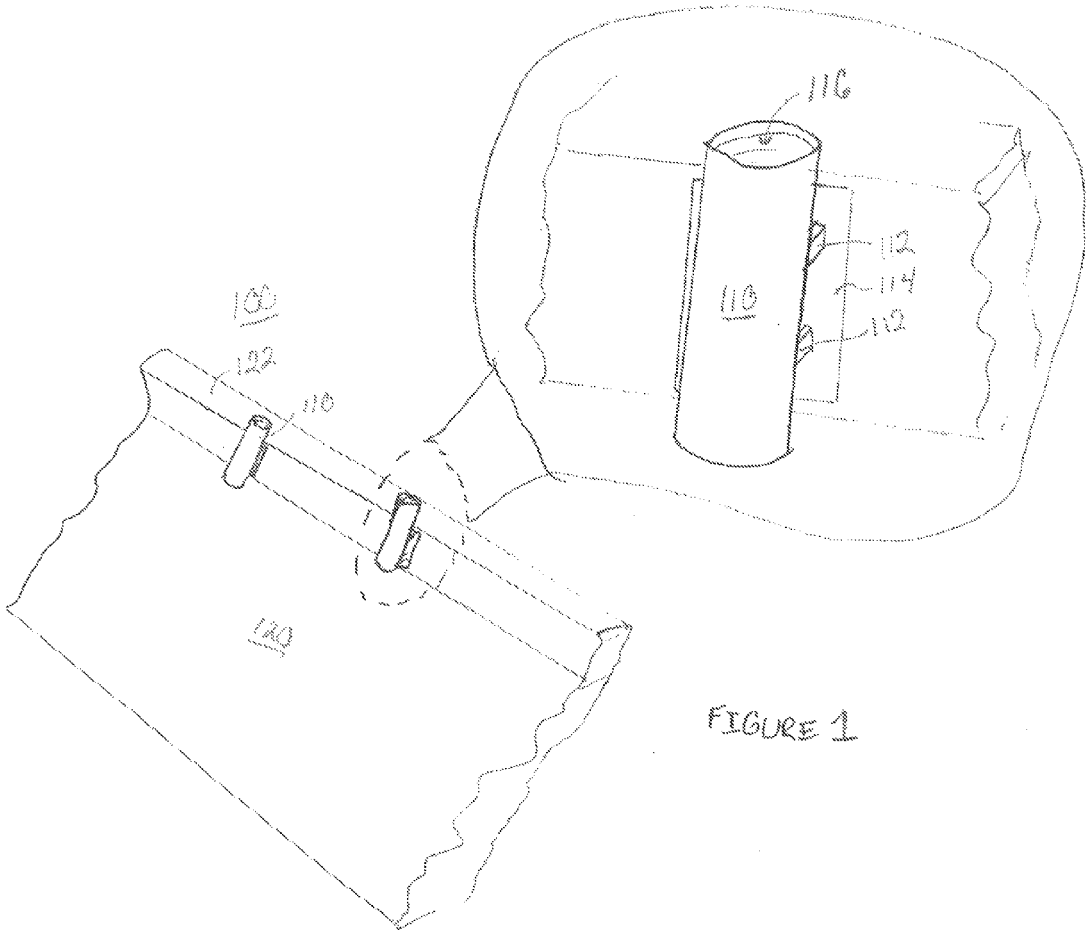
FIG. 1 depicts a rocket launcher mounted on a cut out portion of a ship's side wall in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION OF THE INVENTION

Embodiments of the present invention generally relate to an adaptable rack for aquatic transport. More specifically, embodiments of the present invention relate to an adaptable rack for aquatic transport of bicycles or other articles (e.g., kayak, raft, surfboard, boogieboard, etc.) to prevent scuffing and damaging of the deck of a boat.

FIG. 1 depicts a rocket launcher mounted on a cut out portion of a ship's side wall (e.g., the ship's gunwale) in accordance with one embodiment of the present invention. As shown in the Figure, a cut-out portion of a ship's side wall 100 generally comprises a the inner surface of the side wall 120, and at least one or more rocket launchers 110 mounted adjacent to a top rail 122 of the side wall 120.

A rocket launcher 110 may comprise any rocket launcher device or functional equivalent, suitable for embodiments of the present invention (e.g., any device capable of securely supporting a fishing pole to be cast off the side of a ship, and the forces acting thereon when in use). As shown in the exploded portion of FIG. 1, an exemplary rocket launcher 110 comprises a cylindrical tube 116 having a voluminous interior therein, at least one attaching arm 112 for connecting the cylindrical tube 116 to the side wall 120 of the ship. Optionally, rather than being affixed directly to the side wall 120, the rocket launcher 110 may be connected via the attaching arms 112 to a mounting plate 114, wherein the mounting plate 114 is securely fixed to the side wall 120 of the ship.

Although FIG. 1 describes one exemplary embodiment of a rocket launder 110, embodiments of the present invention may be suitable for any of the various forms of rocket launchers or functional equivalents. For example, although the rocket launcher 110 is shown as an individually-mounted rocket launcher on the side wall of a ship, embodiments of the present invention contemplate the use of (a) sets of rocket launchers mounted on a single bar on the side wall of a ship; (b) multifunctional containers (e.g., cup holders, storage bins, etc) which may have a rocket launcher or equivalent device capable of mounting therein, adjacent the side of a ship; (c) rocket launcher(s) mounted elsewhere on a ship, for example, mounted on a free standing (deck-secured) rack, on a hard top roof of a larger vessel or on the outside surface of the side wall of the ship; (d) built within the sidewall or gunwale of the ship; or the like. For most proposed embodiments of the present invention, it should be appreciated that the structural rocket launcher positioning on the ship is not highly relevant, but rather must solely exist to perform the necessary functions of suitable embodiments of the present invention.

Figure 2A:
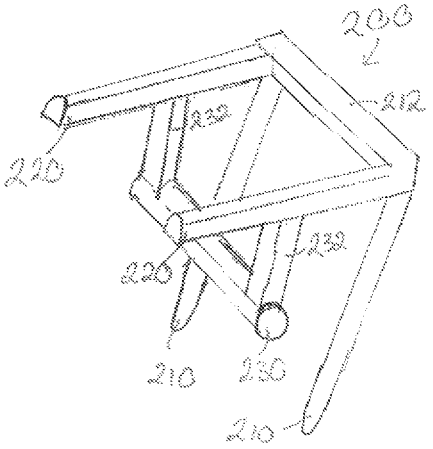
FIGS. 2A-2D depict multiple views of one embodiment of an adaptable rack in accordance with embodiments of the present invention.
Figure 2B:
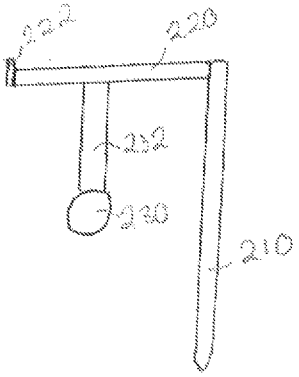
Figure 2C:
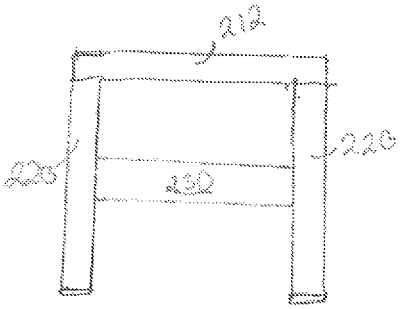
Figure 2D:
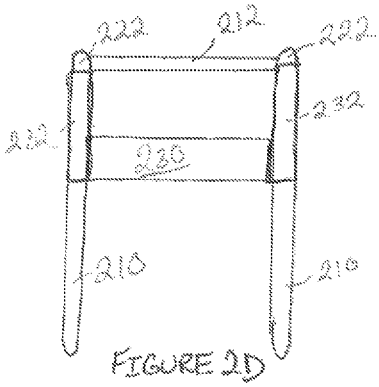

FIG. 2A depicts a perspective view of one exemplary embodiment of a adaptable rack, and FIGS. 2B-2D respectively show a side, top and front view thereof. An adaptable rack 200 generally comprises at least one mounting post 210, a support bar 212, and a plurality of support arms 220. Optionally, a cushion 230 may be provided to assist in supporting and absorbing any undesirable forces against the outer surface of a ship's wall when in use. When provided, the cushion 230 may be attached to the adaptable rack 200 via at least one cushion arm 232. A cushion 230 will generally comprise a non-scuffing, energy-absorbent material, e.g. a polyurethane foam, although any material may be suitable for embodiments of the present invention.

The adaptable rack 200 may be manufactured out of any materials suitable for embodiments of the present invention. In one embodiment, the adaptable rack 200 is manufactured out of a rust-resistant material. In other embodiments, the adaptable rack 200 is manufactured out of a metal, metal alloy, polymer, wood, or any combination thereof. Where a metal or metal allow is utilized, each of the components may be extruded or otherwise formed, and subsequently welded, bolted or otherwise attached in the construction supported by embodiments of the present invention.

The mounting post 210 generally comprises an elongated post capable of securely fitting into a rocket launcher, as described supra. In accordance with one embodiment of the present invention, the shape of the mounting post 210 may be similar to that of a fishing pole, such that adaption to a rocket launcher is inherent. In other embodiments, the shape of the mounting post 210 may have a slightly narrowing taper, getting more narrow towards a bottom end of the mounting post 210. Such a tapering effect may allow for a better friction fit within the rocket launcher once the mounting post is fully positioned therein. In yet further embodiments, a foam padding (not shown), similar to the grip of a fishing pole, may optionally be provided on the bottom end of the mounting post 210 to assist with securing a friction fit.

Although the mounting posts 210 are shown as being perpendicular to the support arms 220, embodiments of the present invention provide the mounting posts 210 are positioned at an angle to allow the support arms 220 to remain generally horizontal when in use within a rocket launcher. As appreciated by those of ordinary skill in the art, a rocket launcher may be built into a boat at an angle to allow a fishing pole to be used in a certain manner. Accordingly, if the rocket launcher is not vertically positioned, the angle between the mounting posts 210 and support arms 220 may be provided so that the support arms 220 are horizontally disposed when adaptable rack 200 is in place within the rocket launcher.

In one embodiment, the mounting posts 210 are adjustable, such that the angle thereof may be changed. In another embodiment, the mounting posts 210 may be extendible or telescoping, to alter the length thereof. In yet another embodiment, the mounting posts 210 may be provided with a gooseneck design, such that the mounting posts 210 may be adjusted to fit more snugly within the rocket launcher. In such an embodiment, a means for adjusting (not shown) the gooseneck portion of the mounting posts 210 may be provided thereon. Such a means may include a screw, a key, similar mechanical device, or the like. Other embodiments support alternative designs to expand or change the width of the mounting posts 210 and cause it to fit more snugly within the rocket launcher.

The support bar 212 generally connects one or more mounting posts 210 to each other, as well as to the support arms 220. Where a single mounting post 210 is provided, the support bar 212 may be centered thereover, and where three or more mounting posts 210 are provided, the support bar 212 may provide for equal spacing therebetween to best balance a load on the support arms 220. The length of the support bar 212 is generally dependent upon the number of mounting posts 210 and the spacing distance between rocket launchers. In view of the unlimited possibilities of such spacing and positioning factors in the industry, the sizing of the support bar 212 and all other components described herein may be dependent solely upon the practical application in which such embodiment is intended to be used.

The support arms 220 generally comprise at least a pair of horizontally disposed arms, capable of supporting a load (e.g., the weight of a bicycle, a canoe, a raft, oars, a beverage cooler, etc.) thereon, although one support arm 220 may be suitable. In one embodiment, the support arms 220 comprise an end cap 222 for assisting in the prevention of any article being supported thereon from sliding off the support arms 220. To that end, the support arms 220 may optionally comprise a coating of a high-friction material, such as a rubber coating, to additionally assist the prevention of articles sliding.

In certain embodiments, it may be desirable to provide an additional support arm brace (not shown) which may alleviate some of the torsional force at the intersection of the support arms 220 and the support bar 212. In one embodiment, the support arm brace may be a bracket or support angled between the support arm 220 and the mounting post 210. In another embodiment, where the rocket launcher is positioned as shown in FIG. 1, a portion of an underside of the support arms 220 may be adapted to rest on the surface of the top rail of the side wall of the ship. In such an embodiment, the portion of the underside of the support arm 220 may be fitted with a padding (not shown) or other material so not to scratch or damage the top rail.

As disclosed above, the adaptable rack 200 may optionally comprise a cushion 230 for assisting the support arms 220 and to assist in preventing any scratching of the side wall of the ship. As a load is placed on the support arms 220, the cushion 230 absorbs the horizontal impact of the force of the load, against the side wall of the ship. Similarly, if the load on the support arms is a bicycle, having pedals, gears, tires, etc., the cushion may also assist in preventing the bicycle from accidentally coming in contact with the side wall of the ship when travelling in the water. Although the cushion 230 is shown as being connected to the adaptable rack 200 via cushion arms 232 extending downward from the support arms 220, the cushion arms 232 may be in the form of any connection means feasible for embodiments of the present invention.

Optional embodiments of the present invention provide additional features and components not shown in the Figures. In one embodiment, an additional securing mechanism for ensuring the adaptable rack stays within the rocket launcher (s) when travelling through rough water is provided. Such securing mechanism may comprise a strap, clamp, tie down, etc., or combinations thereof. Any tie down or strap may be utilized between any stable component of the adaptable rack (e.g., the support bar) and a fixed component on the ship.

Similarly, in other embodiments, it may be desirable to provide an article retention device, for example, for securing the bicycle to the frame and ensuring it does not fall off during transport. In one embodiment, the article retention device may comprise a strap or clamp. In another embodiment, the article retention device may be in the form of the support arms, wherein the support arms are designed in a clamp-like fashion—similar to a ski rack on a car. In such an embodiment, the article (e.g., bicycle) being transported would be "locked" within the clamps, which may further comprise a locking mechanism, requiring a key or the like.

In certain commercial embodiments, it may be advantageous to provide a means for adjusting lengths, widths and angles of each of the structural components of the adaptable rack, so that the adaptable rack may be utilized on different vessels (e.g., on two different boats, on two different areas on the same boat, on a boat and a dock, on boat and a jet ski, etc.) Whereas it is highly unlikely that any two positioning areas (i.e., rocket launcher positioning) are exactly identical, the ability to adjust length, width and angles of each of the components allows for adaptability with the use of the adaptable rack. In addition, by providing flexibility between each of the components, the adaptable rack may also be retracted and bent substantially flat, providing an easier means for storing the device.

Where such embodiments provide adjustability between components, any known means for adjusting may be utilized. In some embodiments, each of the extruded members of the adaptable rack may be telescoping members, utilizing a pin or friction means to securely extend and retract the length and/or width of such member. Similarly, where each angle may be adjustable between members, each intersection between members may be provided, for example, with a tightenable bolt through common apertures at the respective ends of each member. Alternative embodiments of the present invention allow for any known means of adjusting length or angles between adjacent members of a substantially rigid structure.

Figure 3:
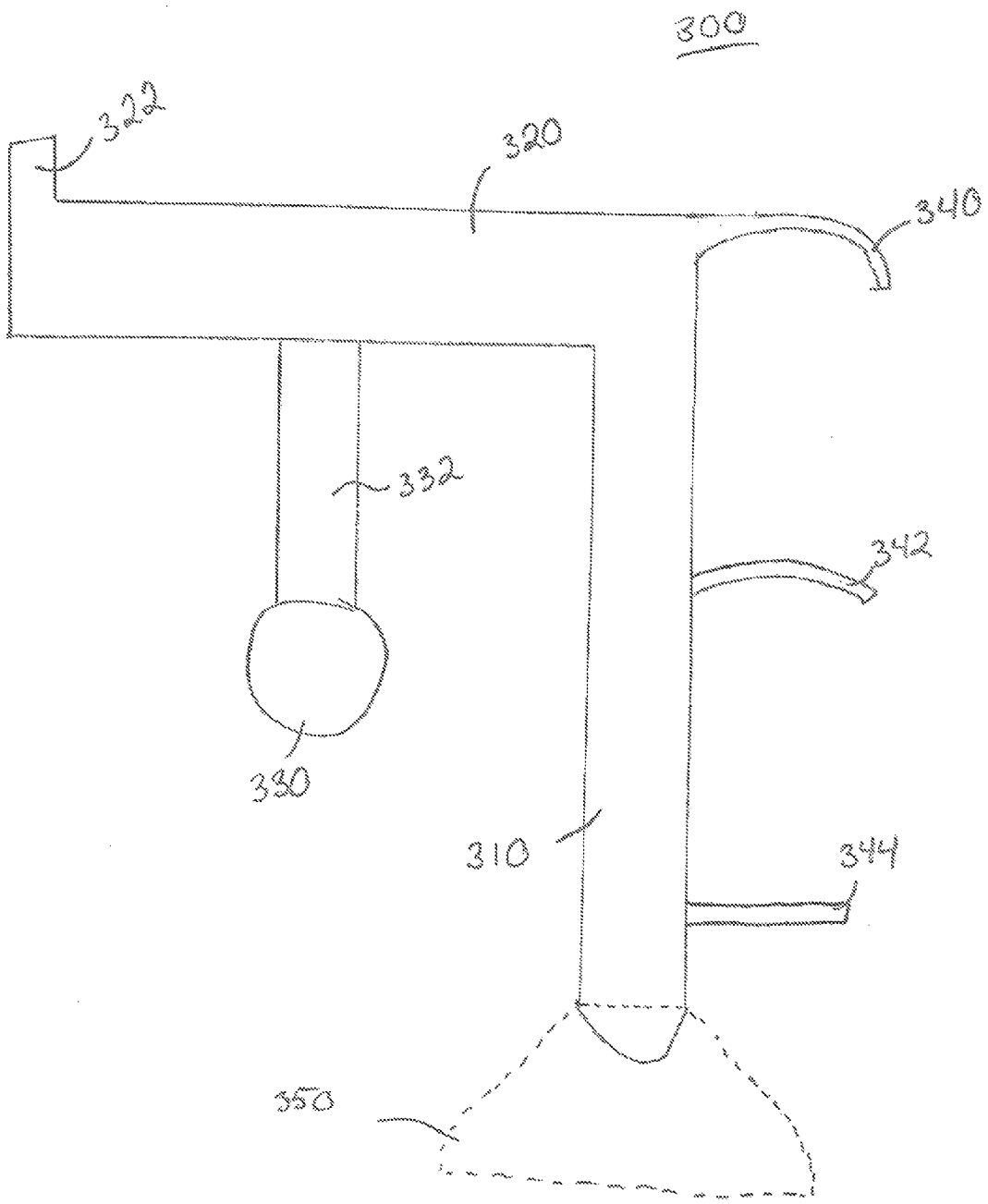
FIG. 3 depicts an adaptable rack in accordance with one embodiment of the present invention.

FIG. 3 depicts an alternative adaptable rack in accordance with one embodiment of the present invention. The adaptable rack 300 may be utilized in an embodiment where by the boat or vessel does not comprise a rocket launcher, as described above, but rather has a plurality of rails around the sides of the deck of the boat. In many embodiments, such types of boats may comprise wood, metal, polymeric or wire/rope-type railings, often with one, two or more of such railings positioned in a vertical alignment to one another adjacent the sides of the boat. For example, a sailboat is known to commonly posses such types of railings.

The adaptable rack 300 generally comprises at least one mounting post 310, a support bar 312, and a plurality of support arms 320. Optionally, a cushion 330 and cushion arm 332 may be provided as described hereinabove. In the embodiment shown, a plurality of railing brackets 340, 342 and 344 may be provided (collectively "railing bracket 340"). The railing bracket 340 may be utilized to support the adaptable rack on and/or against a railing of a boat where applicable. In certain embodiments, where multiple railings are provided, multiple railing brackets 340 may be provided on each of the mounting posts 310, one railing bracket 340 for each of the railings to disperse the forces thereon.

The railing brackets 340 may be provided in any size, shape or structure suitable for embodiments of the present invention. In many embodiments the railing brackets 340 may comprise a hook-like structure for fitting over a rail (often having a circular cross-section). However, as shown by the cross-sectional shapes of each of the three railing brackets 340, 342 and 344 shown in the Figure, any shape, including mere tabular projections, may be suitable depending upon the nature and style of railing on the boat.

The railing brackets 340 may be formed integral with the adaptable rack during construction thereof, or may be welded thereto. In further embodiments, the railing brackets 340 may also be removable, which is described in more detail below in FIG. 4.

The adaptable rack 300 may also comprise an optional support base 350. The support base may comprise any structure designed to support the bottom end of the mounting post 310 against the deck of a boat, to assist in relief of forces acting upon the railing(s). As shown in the Figure, the support base 350 may integrally formed on the bottom end of the mounting post 310 or it may be a separable device for receiving the bottom end of the mounting post 310, as described below with respect to FIG. 4.

Figure 4:
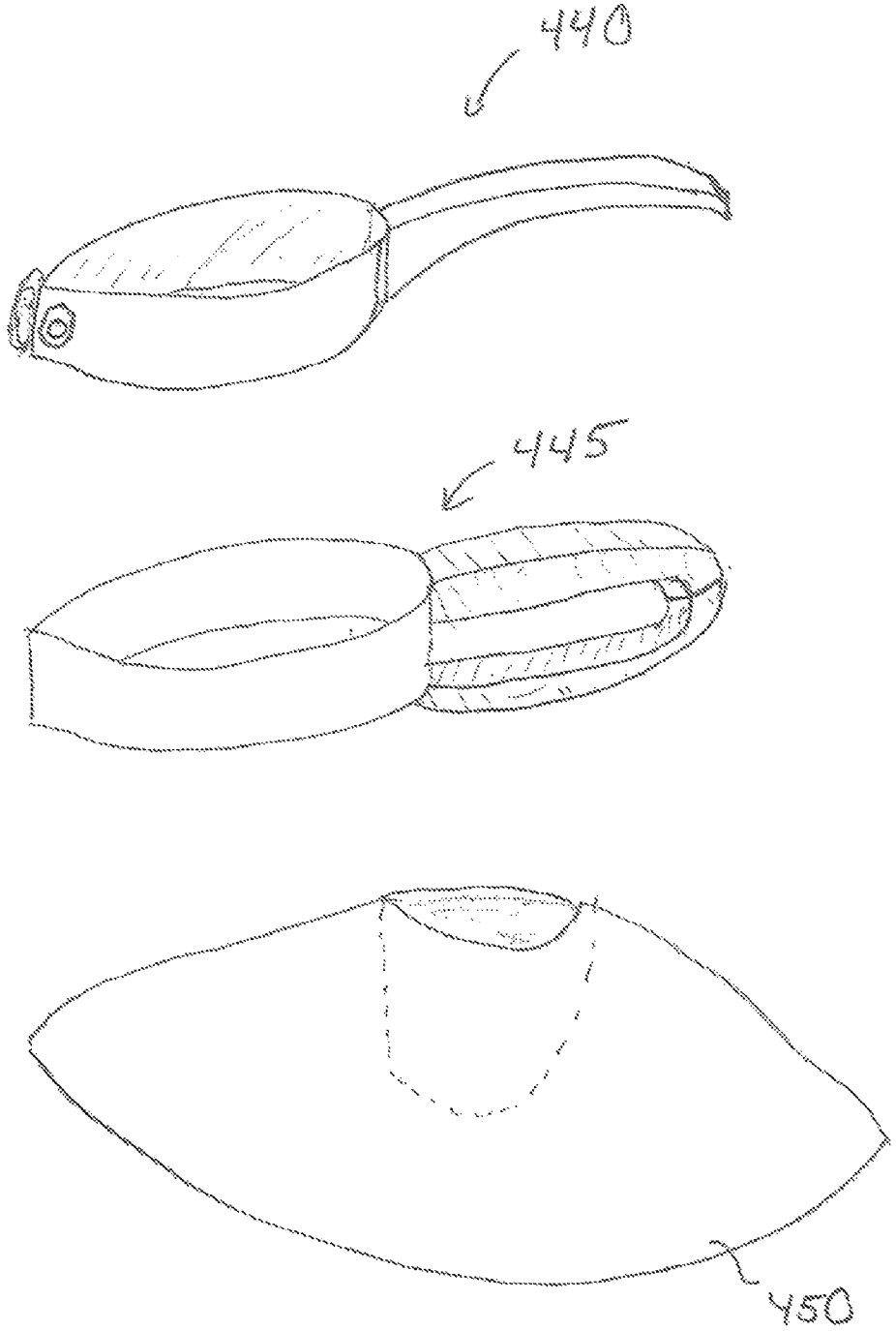
FIG. 4 depicts components of a conversion kit for an adaptable rack in accordance with one embodiment of the present invention.

FIG. 4 depicts components of a conversion kit for an adaptable rack in accordance with one embodiment of the present invention. In many embodiments, it may be desirable to utilize the adaptable rack for rocket launchers (e.g., as in FIG. 2) and utilize it as an adaptable rack for railings (e.g., as in FIG. 3). In some embodiments, to convert such types of adaptable racks, a removable railing support 440 may be slid onto a mounting post, and tightened into position. As shown in FIG. 4, the removable railing support 440 may comprise an O-ring structure capable of tightening (e.g., with a wingnut and screw combination) around the mounting post, once properly positioned thereon. As shown in FIG. 3 above, any number of removable railing supports 440 may provided onto a mounting post to make it suitable for embodiments of the present invention.

An alternative type of removable railing support 445 is also depicted in FIG. 4. As shown therein, a removable railing support 445 may comprise a closable ring for adapting to the railing. Such type of closeable ring may be substantially similar to a climbing clip, which may be suitable for adapting to a wire-type railing, for securing therearound.

A removable support base 450 may also be provided as a component to a conversion kit. As introduced above, the support base 450 may comprise any structure capable of receiving the bottom end of a mounting post and assisting in the stabilization of the adaptable rack against the surface of the deck of the boat. The support base 450 may be made from any material suitable for embodiments of the present invention, but in many embodiments, may be made from a non-skid material that will not mark or tarnish the deck of a boat when in use.

Figure 5:
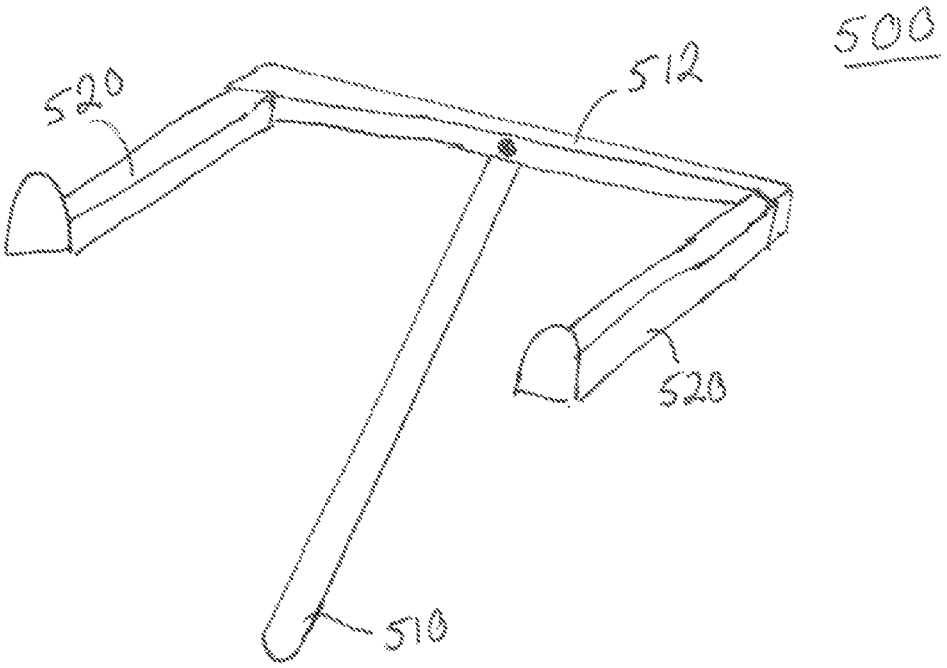
FIG. 5 depicts an adaptable rack in accordance with one embodiment of the present invention.

FIG. 5 depicts an adaptable rack in accordance with one embodiment of the present invention. As shown in the Figure, the adaptable rack 500 generally comprises at least one mounting post 510, a support bar 512, and at least one support arm 520. Similar to the embodiments described above, the mounting post 510 is designed to fit within a rocket launcher (not shown) on a boat. However, in the exemplary embodiment depicted in the Figure, the adaptable rack 510 may utilize its support arm 520, or support arms 520, to support an additional article or a storage apparatus for holding articles.

Figure 6:
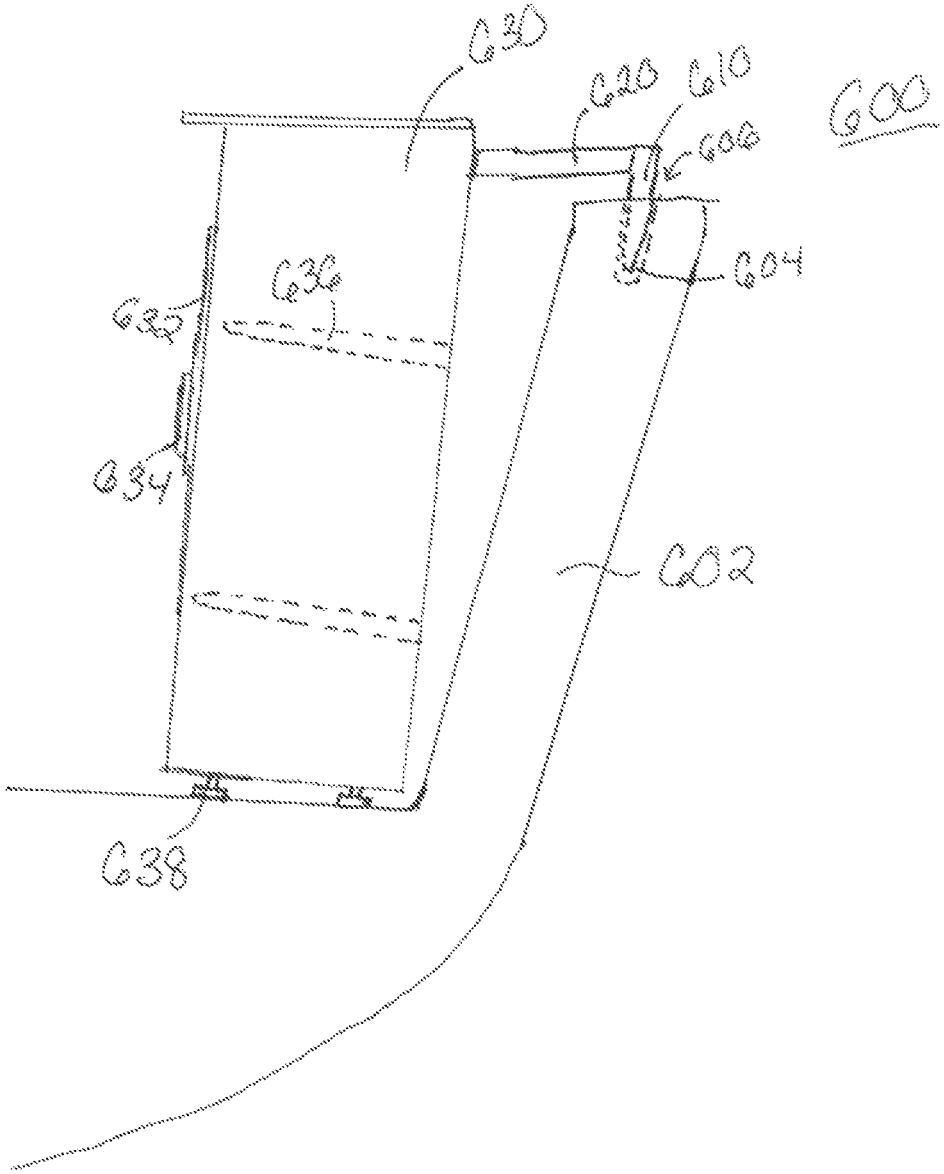
FIG. 6 depicts an adaptable rack supporting a storage device positioned in a rocket launcher, in accordance with one embodiment of the present invention.

FIG. 6 depicts an adaptable rack assembly supporting a storage device positioned in a rocket launcher, in accordance with one embodiment of the present invention. As shown in the Figure, the adaptable rack assembly 600 comprises a boat, partially shown as the boat sidewall (i.e., gunwale) 602, a rocket launcher 604 positioned within the gunwale having an opening 606 on a top surface thereof, a mounting post 610 of an adaptable rack positioned within the rocket launcher 604, a support arm 620 and a storage apparatus 630 supported by the support arm 620.

In many embodiments, the storage apparatus 630 may comprise a storage cabinet, a rack, a safe, a shelving unit, or the like. In the embodiment depicted, the storage apparatus 630 comprises a cabinet having a plurality of shelves 636 therein. To secure the contents, the storage apparatus 630 may comprise one or more doors 632 having a means for opening the door 634 (e.g., a handle, knob, etc.). In addition, the storage apparatus 630 may optionally comprise one or more legs 638 for supporting the bulk of the weight of the storage apparatus 630 on the deck surface. Generally, the legs 638 may comprise a non-stick material to avoid scuffing, but sufficient to help keep the storage apparatus 630 stationary when the boat is moving.

In some embodiments, the storage apparatus 630 is temporarily affixed to the support arm 620. In one embodiment, the storage apparatus 630 is affixed to the support arm 620 using a mechanical fastener (e.g., a screw, bolt, nail, snap, etc.). In another embodiment, the storage apparatus 630 is affixed to the support arm 620 using a structural design, for example, a slot on the back of the storage apparatus 630 for receiving a projection off the end of the support arm 620. In yet another embodiment, the support arm 620 is more permanently affixed to the storage apparatus, and has a means for adapting to the mounting post 610. Such means may include any number of mechanical fasteners, structural designs, or the like.

In additional embodiments of the present invention, the storage apparatus 630 may interchangeable with any other type of storage apparatus as described herein. For example, in one embodiment, a boat owner may utilize a shelving-type cabinet (as shown in FIG. 6), but later need a rack for scuba diving gear. By utilizing embodiments of the present invention, the boat owner may need only to change out the storage apparatus, reaffix it to the support arm(s) and/or the mounting post(s), and such new apparatus is ready to store whatever needs to be transported.

In addition to storage devices, bicycles, and aquatic transport devices (e.g., rafts, kayaks, etc.), embodiments of the present invention may allow for a boat owner to transport a propane/charcoal grill, a refrigerator, a sink/drain for filleting fish, a beverage cooler, and the like. Although a limited number of articles are listed herein, embodiments of the present invention may be utilize to support and transport any device, article, or apparatus plausible that a boat owner may wish to bring onboard.

In further embodiments of the present invention, a rocket launcher may be affixed with a power source, and the adaptable rack may be provided with a means for conducting such power. As such, embodiments of the present invention may be utilized to support powered devices, such as a television, refrigerator, electric stove, etc., without departing from the basic structural design described herein.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this invention.

What is claimed is:

1. An adaptable rack for aquatic transport of an article comprising:

a mounting post comprising a narrowing taper cross-section along its length and a rounded bottom end constructed to frictionally fit inside a rocket launcher and remain supported therein during aquatic transport without additional mechanical fasteners, the rocket launcher comprising a cylindrical tube constructed to support a fishing pole with a round handle, the rocket launcher positioned within a gunwale of en a boat;

a support bar positioned on a top surface of the mounting post;

a plurality of support arms extending from the support bar, the support arms for supporting the article during aquatic transport;

at least one cushion arm extending from a bottom surface of one of the plurality of support arms;

a cushion attached to the at least one cushion arm for preventing scuffing on an inner surface of a sidewall of the boat; and wherein the mounting post, the support bar, the plurality of support arms, and the at least one cushion arm form a single integral unit devoid of any mechanical fasteners.

2. The adaptable rack of claim 1, wherein the support arms further comprise an end cap on a free end thereof.

3. The adaptable rack of claim 1, further comprising at least two mounting posts for fitting inside at least two rocket launchers on the boat.

4. The adaptable rack of claim 1, wherein at least one of the mounting post, the support bar or the support arms are adjustable to allow for varying lengths.

5. The adaptable rack of claim 1, wherein the article comprises a bicycle.

6. An adaptable rack for aquatic transport of an article comprising:

a mounting post comprising a narrowing taper cross-section along its length and a rounded bottom end constructed to frictionally fit inside a rocket launcher and remain supported therein during aquatic transport without additional mechanical fasteners, the rocket launcher comprising a cylindrical tube constructed to support a fishing pole with a round handle, the rocket launcher positioned within a gunwale of a boat;

a support bar positioned on a top surface of the mounting post;

a plurality of support arms extending from the support bar, the support arms for supporting the article during aquatic transport;

at least one railing bracket for connecting to a railing on a boat at least one cushion arm extending from a bottom surface of one of the plurality of support arms;

a cushion attached to the at least one cushion arm for preventing scuffing on an inner surface of a sidewall of the boat; and wherein the mounting post, the support bar, the plurality of support arms, and the at least one cushion arm form a single integral unit devoid of any mechanical fasteners.

7. The adaptable rack of claim 6, further comprising a support base for supporting the mounting post on a surface of a deck of the boat.

8. The adaptable rack of claim 6, wherein the at least one railing bracket is removable.

9. The adaptable rack of claim 6, wherein the at least one railing bracket comprises one of an O-ring assembly or a climbing clip.

10. The adaptable rack of claim 6, wherein the support arms further comprise an end cap on a free end thereof.

11. An adaptable rack comprising:

a mounting post comprising a narrowing taper cross-section along its length and a rounded bottom end constructed to frictionally fit inside a rocket launcher and remain supported therein during aquatic transport without additional mechanical fasteners, the rocket launcher comprising a cylindrical tube constructed to support a fishing pole with a round handle, the rocket launcher positioned within a gunwale of a boat;

a support bar positioned on a top surface of the mounting post;

a plurality of support arms extending from the support bar, the support arms affixed to one of a storage apparatus or an article; and wherein the mounting post, the support bar, and the plurality of support arms form a single integral unit devoid of any mechanical fasteners.

12. The adaptable rack of claim 11, wherein the storage apparatus comprises one of a storage cabinet, a rack, a safe, or a shelving unit.

13. The adaptable rack of claim 11, wherein the article comprises one of a propane or charcoal grill, a refrigerator, a sink and cutting surface for fileting fish, a beverage cooler, or combinations thereof.

* * * * *